United States Patent [19]

Williamson

[11] 4,196,424

[45] Apr. 1, 1980

[54] LOCK TAG

[76] Inventor: Robert D. Williamson, 7350 NW. First Ct., Pembroke Pines, Fla. 33024

[21] Appl. No.: 870,673

[22] Filed: Jan. 19, 1978

Related U.S. Application Data

[63] Continuation-in-part of Ser. No. 689,336, May 24, 1976, Pat. No. 4,087,802.

[51] Int. Cl.[2] ..... G08B 21/00; A44B 9/00

[52] U.S. Cl. ..... 340/572; 24/150 B; 206/573

[58] Field of Search ..... 340/572; 224/0.5; 206/573, 580; 24/150 B, 156 R, 157 R, 263 R

[56] References Cited

U.S. PATENT DOCUMENTS 3,914,829 10/1975 Paskert ..... 340/572

*Primary Examiner*—Glen R. Swann, III

*Attorney, Agent, or Firm*—Robert J. Van Der Wall

[57] ABSTRACT

For use with an electronic antishoplifting surveillance system, a reusable, low cost telltale tag intended to be attached to merchandise such as garments includes a passive electronic circuit or other stimulus and it can be locked on the merchandise so it can only be removed with a key held by authorized personnel. The passive electronic circuit serves to activate the surveillance system.

14 Claims, 8 Drawing Figures

LOCK TAG

CROSS-REFERENCE TO OTHER APPLICATION

This application is a continuation-in-part to Applicants's co-pending application, Ser. No. 689,336, filed May 24, 1976, titled METHOD AND APPARATUS FOR ELECTRONIC SURVEILLANCE OF PRECISELY DEFINED CONTROL ZONE now U.S. Pat. No. 4,087,802.

BACKGROUND OF THE INVENTION

This invention relates to the field of electronic merchandise surveillance utilized to minimize shoplifting losses, and, more particularly to tamper-resistant telltale tags that include means for removal from garments and other merchandise only by authorized personnel and without damaging the merchandise when removed.

In recent years, there have been large increases in losses incurred by retail merchants as a result of shoplifting, principally by amateur thieves. This has resulted in a flurry of inventive activity seeking to improve upon existing methods and equipment for inhibiting and detecting shoplifting without inhibiting sales or adding significantly to costs. Such inventions run the gamut of equipment that attaches directly to the merchandise, as disclosed by Ephraim, U.S. Pat. No. 4,000,488, to magnetically activated alarm systems such as taught by Fearon, U.S. Pat. No. 3,790,945, and Benassi, U.S. Pat. No. 3,938,125, to powered tag activated systems illustrated by McGlinchey et al, U.S. Pat. No. 3,665,448, and on to unpowered electronic tag activated systems such as shown by Miller, U.S. Pat. No. 3,609,741, Cole et al, U.S. Pat. No. 3,707,711, Martens, U.S. Pat. No. 3,711,848, Gordon et al, U.S. Pat. No. 3,895,368, and the co-pending application by Applicant, Ser. No. 689,336, filed May 24, 1976 for Method and Apparatus for Electronic Surveillance of Precisely Defined Control Zone now U.S. Pat. No. 4,087,802

The most recent inventive activity appears to have been directed to unpowered electronic tag activated systems, possibly because the size and cost of the tags is reduced, there is no need to purchase or replace batteries, and the circuitry in the tag can be greatly simplified. Indeed, the circuitry in Gordon et al, has been simplified down to a rectifier and dipole antenna, but it tends to be too large to be easily embedded in a small tag, and cannot unobtrusively be hidden in a small paper tag because the length of antenna required, even when folded up, is too long.

All such surveillance systems should include features that permit portability of merchandise within certain boundaries, such as the store premises, resist tampering, deactivation or removal of the tag by unauthorized persons, and facilitate quick and effective deactivation or removal by authorized personnel without damaging the merchandise. However, many systems either ignore these features, are hopelessly impractical or expensive, or include other detrimental side effects.

For example, Ephraim discloses a tag adhesively attached to an article of merchandise, but with at least one wire running directly from the article of merchandise to the alarm system. This technique undoubtedly resists tampering, deactivation or removal of the tag by unauthorized persons, but obviously destroys reasonable portability within a store's premises, and would be impractical and expensive in most retail situations.

Fearon and Gordon et al, while representing complete systems, completely ignore these considerations, and Benassi virtually does so. However, Miller and Mcglinchey et al both recognize and deal with these issues, and represent the closest patented art known to Applicant. Miller utilizes a key to deactivate the tag by short circuiting an antenna. Miller does not reveal how to prevent removal of the tag, but deals effectively with the questions of how to prevent unauthorized persons from deactivating the system and how to permit authorized personnel to quickly and effectively deactivate the tag without damaging the merchandise. Miller unfortunately fails to teach any way that it could be attached or removed from merchandise without damage.

In McGlinchey et al, a tag is powered with a wristwatch battery and the circuit includes a safety pin type device that can be passed through the merchandise. This reference discloses a method and apparatus permitting portability of merchandise within certain boundaries, resists tampering, deactivation or removal of the tag by unauthorized persons, and facilitates quick and effective deactivation and removal by authorized personnel utilizing a temporary inhibit signal. However, it suffers from the impracticality and expense of requiring a battery, and the pin may damage the merchandise when the tag is removed.

The only other relevant art known to Applicant is the commercial embodiment of Gordon et al marketed by Sensormatic Electronics Corporation of Hollywood, Florida, which is offered with tags that are mechanically attached using a tack that is intended to penetrate fabric or other merchandise and virtually cannot be removed except with special cutting or other bulky equipment furnished as part of the system. No electrical circuitry is employed in attaching the tag and the tag includes no apparatus for preventing damage to the merchandise when the tag is opened by authorized personnel.

SUMMARY OF THE INVENTION

With the foregoing in mind, it is a principal object of the invention to provide an apparatus for harmlessly attaching a telltale tag to merchandise in a manner to resist tampering, deactivation or removal by unauthorized persons, while facilitating quick and effective deactivation and removal by authorized personnel, all without damaging the merchandise.

A related object and advantage of the invention is to provide in the apparatus an automatic means of protecting merchandise from damage when the invention is being removed from the merchandise.

A second principal object of the invention is to satisfy the foregoing object with a tag that is economical to produce, use, and which is repeatedly reusable.

Another object of the invention is to provide a tag that eliminates any need for a battery or other power source in the tag.

A further object of the invention is to provide in a substantially similar appearing tag a plurality of mutually exclusive keys for deactivation and removal of the tag, to afford the user selectivity in which members of generally authorized personnel may remove said tags.

A related object of the invention is to provide the foregoing object with "master key" capability whereby a first key to remove the tag may work with a plurality of different tags, but a second such key will function with only one of a plurality of different tags.

Another object of the invention is to provide a tamper resistant base to which may be attached labels bearing size, price, lot number, brand name, store logo, department number, inventory control designation and like data. Said labels may be affixed with a pressure sensitive adhesive and can be replaced or covered over each time the tag is reused.

An additional object of the invention is to provide a tag that is small in size and completely insensitive to directional orientation.

One more object of the invention is to provide a tag having compatability with a surveillance system that eliminates over-range difficulties.

A further object of the invention is to provide a tag with a circuit that is small enough to be placed in a tag that is not bulky, awkward to handle, expensive to use, or a detriment to sales.

These and other objects and advantages are accomplished in accordance with the broad aspects of the present invention by the use of a lock tag comprising flat, elongated, split housing and a cap, both fabricated from tamper-resistant material. The material will preferably be moldable and will contain a stimulus to the surveillance system, such as an electrical circuit. If the housing is moldable, the circuit can be molded into one side of the split housing. The housing also contains a keyhole in open communication with a key rotation chamber which is in open communication with a slot.

This slot, in turn, is in open communication with a bore, through which passes in close fitting but movable relationship the long leg of a U-shaped hardened bar. The lower end of the bar's long leg reaches down to and is designed to traverse the length of the slot. The lower end is formed into a hinged dog, which dog will jam in the slot and prevent upward movement of the bar unless lifted by a key.

The metallic key is held only by personnel authorized to open tags of this class. The class is defined by key-like grooved surfaces formed in the key rotation chamber. To lift the dog, the key is inserted through the keyhole up the tag to the key rotation chamber. Using a handle of the key still projecting out of the keyhole, the key is turned so that its head rotates through the key rotation chamber, which can only occur if the grooved surfaces on the head of key match grooved surfaces in the key rotation chamber. After rotation, the key can be moved up the slot to lift the dog and push up the bar. The key then can be readily withdrawn by following the reverse procedure.

The cross leg of the U-shaped bar is embedded in the cap of the tag. The tag is closed when the cap comes into aligned proximity with the split housing which occurs when the bar is near its lower-most position.

The U-shaped hardened bar also has a short leg which is formed with a needle-sharp point called the prong. The prong is intended to pierce merchandise such as clothing fabrics, and it penetrates into and resides in a cavity in the tag housing when the tag is closed with the cap in aligned proximity with the housing. The tag is attached to garments by clamping a portion of fabric between the cap and housing in such a way that the prong pierces a part of the fabric and resides at least part way into the cavity provided for it in the housing. Of course, once the tag is closed with fabric or other merchandise clamped between the cap and housing, it cannot be opened except with the proper key.

Of course, other means for attaching the tag to the merchandise could be employed, such as with serrated jaws between the cap and housing. This means would contemplate use with merchandise that would be damaged when pierced by the prong, and in this case, the prong would simply be removed.

The cap is formed with a flat prong guard on its underside, which is attached to it in a hinged connection at the side of the cap remote from the prong. When the tag is closed, the prong guard retracts into a channel provided for it on the underside of the cap. But when the tag is open, the guard is deployed in a position to protect fabric or other merchandise from becoming caught on the prong. Deployment is preferably effected by molding the guard integrally with the cap, but in a deployed position. The guard is fabricated from a resilient material. When the tag is closed, the guard is retracted into the channel provided for it, but springs out to its normally deployed position as soon as the tag is opened. The guard has a forked end to fit around the prong when retracted into the channel as the tag is closed.

The housing is split to facilitate assembly when the tag is manufactured and serves no part in the tag's use. The housing will be provided with closures so that it cannot be opened without destruction of the closures once it has been assembled.

DETAILED DESCRIPTION

Figure 1:
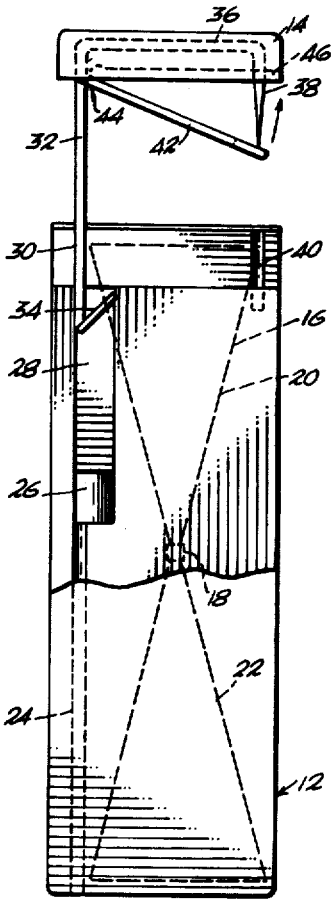
FIG. 1 is a partially cut away front elevation of the inventive tag in an open configuration showing the prong guard in a deployed position.

Referring now to each of the foregoing Figures, a preferred embodiment of the invention will now be described. FIG. 1 discloses a flat, elongated, split housing 12 and cap 14 of the inventive tag, which are preferably molded from a tough plastic material such as polypropylene or PVC to make the tag tamper resistant. Molded into one side of the housing 12 will be a stimulus 16 to the surveillance system (not shown but disclosed in Inventor's co-pending application Ser. No. 689,336, filed May 24, 1976, now U.S. Pat. No. 4,087,802). That stimulus preferably will comprise a diode 18 connected to parallel inductance and capacitance elements 20 and 22 shown abstractly here.

The housing 12 contains a long, flat keyhole 24. The keyhole is made long to frustrate efforts to pick the locking mechanism of the tag and to orient any implements inserted other than a key away from the dog 34 that locks the tag. The keyhole 24 is in open communication with a key rotation chamber 26 which is in open communication with a slot 28. The slot 28 is in open communication with a bore 30, through which passes in close fitting but movable relationship the long leg 32 of a U-shaped hardened bar, preferably made from case hardened steel.

The lower end of the bar's long leg 32 reaches down to and is designed to traverse the length of the slot 28, although in FIG. 1 it is shown at the upper end thereof. The lower end of the bar's long leg 32 is formed into a hinged dog 34. The dog 34 is of slightly greatly length than the width of the slot 28 and is oriented in an upward direction. It is formed so it is urged to seek a position normal or perpendicular to leg 32. The result is that the dog 34 will jam in slot 28 when upward movement is attempted, unless the dog 34 is held upward by a key.

The cross leg 36 of the U-shaped bar is embedded in and holds the cap 14 of the tag. The U-shaped bar also has a short leg which is formed into a needle sharp prong 38. The prong is intended to pierce merchandise such as that made with fabrics. Of course other means such as jaws (not shown) could be employed between the cap 14 and housing 12 if the merchandise or fabric would be damaged by being pierced by the prong 38. In this event, the prong 38 would be eliminated, but the tag would function in much the same manner.

The housing 12 has a cavity 40 which is intended to receive and shield from tampering the prong 38 when the tag is closed. When the tag is open, a prong guard 42 is deployed from a hinge 44 in a position to protect fabric or other merchandise from becoming caught on the prong 38. The prong guard 42 is provided with a channel 46 on the underside of the cap 14 into which the prong guard 42 retracts when the tag is closed.

Figure 2:
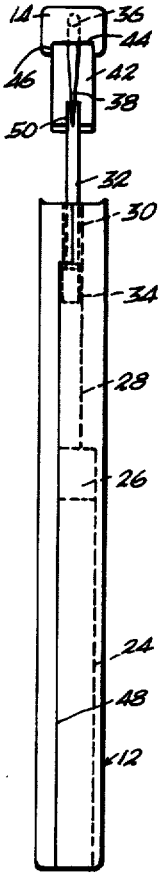
FIG. 2 is a side elevation of the inventive tag in an open configuration showing the prong guard in a deployed position.

Turning now to FIG. 2, the joint 48 of the split housing 12 is visible. In phantom are also shown the flat keyhole 24, the key rotation chamber 26, the slot 28, the bore 30, the hinged dog 34, and the cross leg 36 of the U-shaped bar. Also shown are the long leg 32 of said bar, the cap 14, the prong 38, the prong guard 42, the hinge 44 of the prong guard. Of particular interest in this view are the forked end 50 of the prong guard 42 and the channel 46 of the cap 14 into which the prong guard 42 can retract when the tag is closed.

Figure 3:
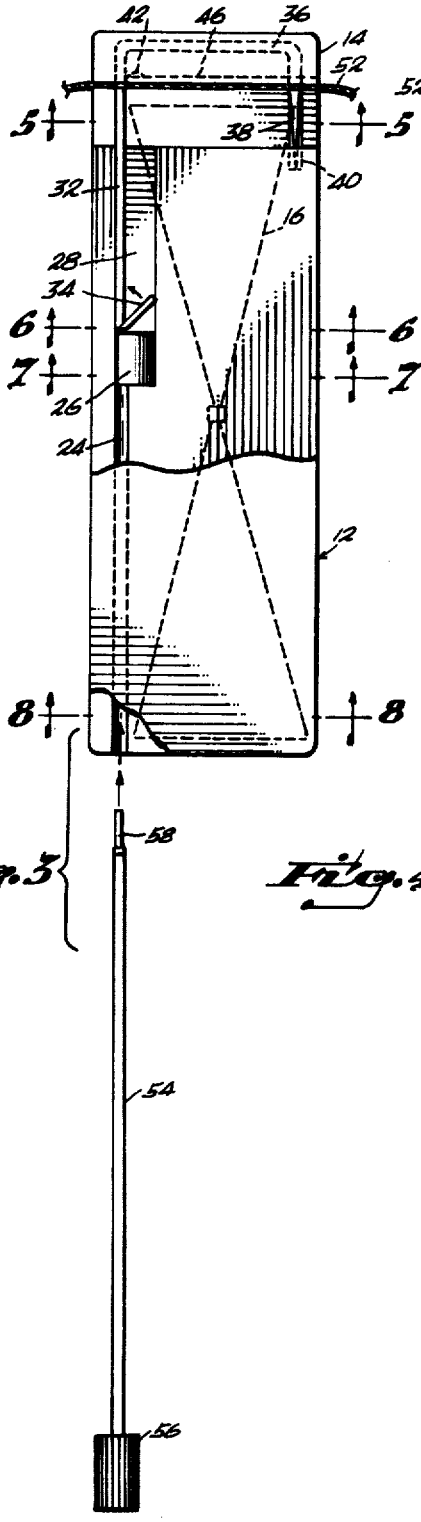
FIG. 3 is a partially cut away front elevation of the inventive tag and key with tag shown closed on fabric and key aligned to insert into the tag.

FIG. 3 shows a closed tag with the cap 14 in aligned proximity with the housing 12 and with fabric 52 clamped therebetween. The prong's 38 residence in the cavity 40 and the prong guard's 42 retraction into the channel 46 are evident. This view also shows the dog 34 on the long leg 32 of the U-shaped bar, near the lower end of the slot 28, where it rests when the tag is closed. The dog 34 may be lifted as shown by the arrow by the insertion of a key 54 into the long flat keyhole 24, rotating the key 54 using its handle 56, when its head 58 reaches the key rotation chamber 26, and then moving the head of the key up the slot 28 to lift and hold up the dog 34 as the tag is opened.

Figure 4:
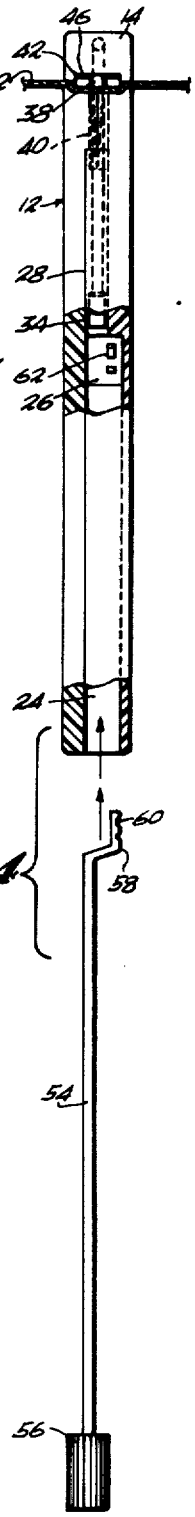
FIG. 4 is a partially cut away side elevation of the inventive tag and key in the same mode as in FIG. 3 .

In FIG. 4, fabric 52 is shown clamped between the cap 14 and housing 12. The prong guard 42 is retracted into the channel 46 around the prong 38, which extends down into the cavity 40. The dog 34 is near the lower end of the slot 28 because the tag is closed. The head 58 of the key 54 is shown aligned with the keyhole 24, and grooved surfaces 60 on the head 58 of the key are generally shown. Inside the key rotation chamber 16, corresponding grooved surfaces 62 are visible in a cut away portion of FIG. 4, which will prevent turning key 54 using handle 56 unless the grooved surfaces 60 of the key head 58 match the grooved surfaces 62 of the key rotation chamber 26.

Figure 5:
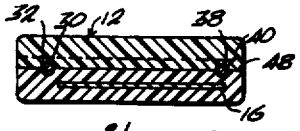
FIG. 5 is cross-section of the tag taken at line 5—5 at FIG. 3.

FIG. 5 discloses split housing 12, a molded-in stimulus 16, the long leg 32 of the U-shaped bar inside bore 30, the joint 48 in the housing, and the prong 38 inside the cavity 40, all in cross-section.

Figure 6:
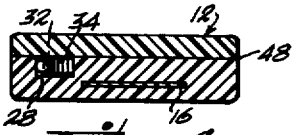
FIG. 6 is a cross-section of the tag taken at line 6—6 of FIG. 3.

FIG. 6 in the same fashion shows the joint 48 in split housing 12, the stimulus 16, the dog 34 on the end of the long leg 32 in slot 28.

Figure 7:
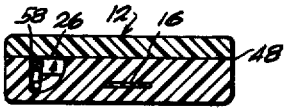
FIG. 7 is a cross-section of the tag taken at line 7—7 of FIG. 3.

So also FIG. 7 illustrates joint 48 in housing 12, stimulus 16, key rotation chamber 26, and the addition of key head 58 poised to rotate with the arrow into alignment with the dog (shown in FIG. 6).

Figure 8:
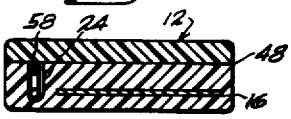
FIG. 8 is a cross-section of the tag taken at line 8—8 of FIG. 3.

Finally, FIG. 8 shows joint 48 in housing 12, stimulus 16, and keyhole 24, with the addition of key head 58 in keyhole 24.

It will be evident from the foregoing that substantial advantages accrue from the invention. These include harmlessly attaching a telltale tag to merchandise in a manner to resist tampering, deactivation or removal by unauthorized persons while facilitating quick and effective removal by selectively authorized personnel, all without damaging the merchandise, and to do so with a reusable tag requiring no source of power. The preferred embodiment of the stimulus is an electrical circuit comprising a diode connected to parallel inductance and capacitance elements, which is a passive circuit having signal mixing capability. That circuit is compatible with a surveillance system which eliminates overrange difficulties, as disclosed in Inventor's co-pending application, Ser. No. 689,336, filed May 24, 1976, now U.S. Pat. No. 4,087,802, but is substantially insensitive to directional orientation and is small in size.

Moreover, the invention includes a locking mechanism susceptible to "master key" capability and mutually exclusive classes of authorized personnel, yet is easy to open without bulky equipment that may damage the merchandise. It also includes the means to automatically protect the merchandise from damage when the tag is being removed.

While the invention has been described in connection with a preferred embodiment, it will be understood that there is no intention thereby to limit the invention. On the contrary, there is intended to be covered all alternatives, modifications and equivalents as may be included within the spirit and scope of the appended claims, which are the sole definition of the invention.

What is claimed is:

1. In a telltale tag including a stimulus to activate an electronic surveillance system, and having an improved means to selectively attach, close and lock the tag to merchandise the improvement comprising:

a housing containing therein a bore and a substantially uniform width slot in open communication with the bore;

a bar in close fitting but movable internal relationship with the bore, said bar having a prong to pierce the merchandise and a resiliently depending dog of slightly greater length than the width of the slot in which it resides, said dog being urged toward a position so it will jam in the slot locking the tag when unauthorized opening of the tag is attempted; and a cavity in the housing in which the prong at least partially protectly resides when the tag is closed.

2. The improved telltale tag of claim 1 which further includes means to unlock the tag comprising:

a keyhole in the housing; and a key to move the dog out of a position where it will jam in the slot, thus permitting authorized opening of the tag.

3. The improved telltale tag of claim 2 which further comprises a key turning chamber in the housing in open communication with the keyhole and the slot, said chamber constructed so that at least a portion of the slot will be out of alignment with the keyhole.

4. The improved telltale tag of claim 3 wherein the key turning chamber and key are provided with mating and complementary keying projections and grooves.

5. The improved telltale tag of claim 1 which further comprises a prong guard having an end to fit around the prong, said guard being resiliently deployed at an angle to protect merchandise from snagging on the prong when the tag is open.

6. The improved telltale tag of claim 1 wherein the bar is U-shaped, having the dog on one leg and the prong on the other leg.

7. The improved telltale tag of claim 6 which further comprises:

a cross leg of the U-shaped bar embedded in a cap;

a channel in the underside of the cap; and a prong guard resiliently depending from a hinge connecting said prong guard to the cap at a place remote from the prong, said prong guard being sized to fit within the channel, having a forked end to fit around the prong, deployed downwardly at an angle sufficient to shield the prong when the tag is open, and retracted within the channel when the tag is closed.

8. In a telltale tag including a stimulus to activate an electronic surveillance system, and having an improved means to selectively attach, close and lock the tag to merchandise, the improvement comprising:

a housing;

a keyhole in the housing;

a key turning chamber in the housing in open communication with the keyhole;

a substantially uniform width slot in the housing in open communication with the key turning chamber, but with at least a portion thereof offset from alignment with the keyhole;

a bore in the housing in open communication with the slot, said bore penetrating the wall of the housing;

a bar having a prong to pierce the merchandise and traversing the bore in close fitting but movable relationship, said bar extending into the slot and having a resilient depending dog of slightly greater length than the width of the slot in which it resides, said dog being urged toward a position so it will jam in the slot, locking the tag when unauthorized opening of the tag is attempted, and a cavity in the housing in which the prong at least partially protectedly resides when the tag is closed.

9. The improved telltale tag of claim 8 which further comprises a key to move the dog out of a position where it will jam in the slot, thus permitting authorized opening of the tag.

10. The improved telltale tag of claim 9 wherein the key turning chamber is provided with keying projections and grooves and the key is provided with grooves corresponding to the projections of the key turning chamber.

11. The improved telltale tag of claim 8 which further comprises a prong guard having an end to fit around the prong, said guard being resiliently deployed at an angle to protect merchandise from being damaged by the prong when the tag is open.

12. The improved telltale tag of claim 8 wherein the bar is U-shaped having the dog on one leg and the prong on the other leg.

13. The improved telltale tag of claim 12 which further comprises:

a cross leg of the U-shaped bar embedded in a cap;

a channel in the underside of the cap; and a prong guard resiliently depending from a hinge connecting said prong guard to the cap at a place remote from the prong said prong guard being sized to fit within the channel, having a forked end to fit around the prong, deployed downwardly at an angle sufficient to shield the prong when the tag is open, and retracted within the channel when the tag is closed.

14. In a telltale tag including a stimulus to activate an electronic surveillance system, and having an improved means to selectively attach, close and lock the tag to merchandise, the improvement comprising:

a housing;

a long flat keyhole in the housing;

a key turning chamber in the housing in aligned open communication with the keyhole;

a substantially uniform width slot in the housing in aligned open communication with the key turning chamber, but with a portion thereof offset from the alignment of the keyhole;

a bore in the housing in aligned open communication with the slot, said bore penetrating the wall of the housing;

a U-shaped bar having as one leg a prong to pierce the merchandise, as another a long leg traversing the bore in close fitting but movable relationship, said long leg extending down into the slot and having on its lower end a hinged upwardly depending dog of a slightly greater length than the width of the slot, said dog being resiliently depending from a hinge connecting said prong guard to the cap at a place remove from the prong, said prong guard being sized to fit within the channel, having a forked end to fit around the prong, deployed downwardly at an angle sufficient to shield the prong when the tag is open, and retracted within the channel when the tag is closed;

a cavity in the housing in which the prong at least partially protectly resides when the tag is closed; and a key to lift the dog, permitting the tag to be opened, the prong to be withdrawn from the cavity and merchandise, the prong guard to be deployed, and the merchandise to be withdrawn from the tag.

* * * * *